United States Patent [19]

Drew

[11] 4,038,932

[45] Aug. 2, 1977

[54] CHAIN CARRIAGE SYSTEM

[76] Inventor: Julius Drew, 70 Joly Street, Ile Bizarre, Quebec, Canada

[21] Appl. No.: 616,827

[22] Filed: Sept. 25, 1975

[51] Int. Cl.[2] ..... D05B 21/00

[52] U.S. Cl. ..... 112/121.12

[58] Field of Search ..... 112/121.12, 121.11, 112/121.15, 65, 102, 204, 205, 203

[56] References Cited

U.S. PATENT DOCUMENTS

| | | | |
|---|---|---|---|
| 1,637,373 | 8/1927 | Fisher | 112/121.12 |
| 3,440,980 | 4/1969 | Bono | 112/121.12 |
| 3,680,508 | 8/1972 | Baig et al. | 112/121.12 |
| 3,734,038 | 5/1973 | Taketomi | 112/121.15 |
| 3,754,520 | 8/1973 | Bennison | 112/121.12 |
| 3,810,414 | 5/1974 | Gerber | 112/121.12 X |

FOREIGN PATENT DOCUMENTS

| | | | |
|---|---|---|---|
| 2,037,222 | 2/1971 | Germany | 112/121.12 |

*Primary Examiner*—H. Hampton Hunter
*Attorney, Agent, or Firm*—Diller, Brown, Ramik & Wight

[57] ABSTRACT

A contour stitching system in which there is provided a stitch pattern cartridge for use with a contour stitching machine for making a predetermined stitch pattern in juxtaposed garment pieces. The machine has a sewing head with a threaded needle. A clamping member releasably secures the juxtaposed garment pieces in a predetermined plane and displaces them under the needle of the sewing head. A follower means is associated with the clamping member for displacing same. The cartridge comprises a housing having a top wall with a guide slot therein which defines a predetermined stitch pattern path. Engagement drive means is provided for displacing the follower means when placed in the guide slot and in a predetermined manner whereby the garment pieces will be displaced under the needle in a manner determined by the pattern path of the guide slot.

14 Claims, 5 Drawing Figures

Fig. 1
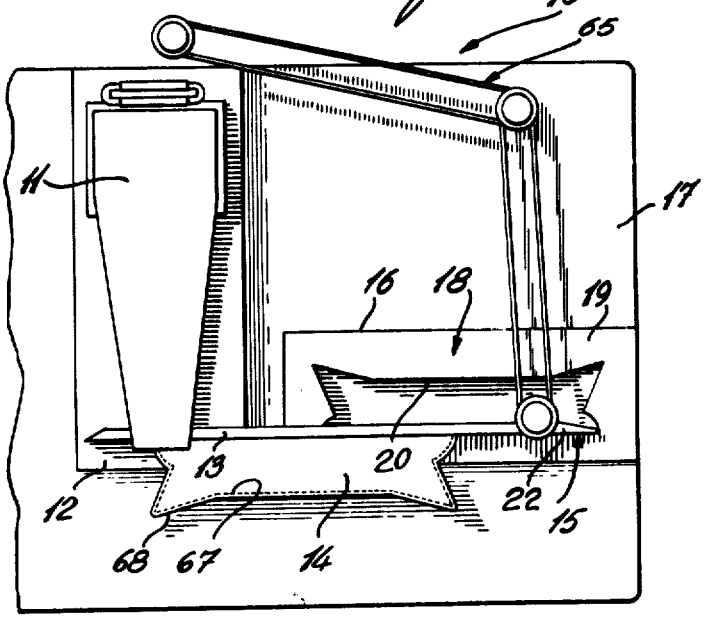
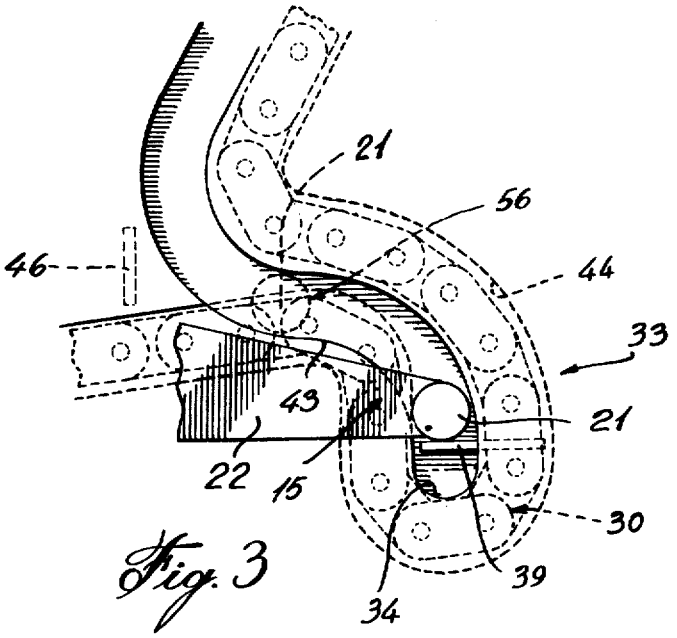
Fig. 3

CHAIN CARRIAGE SYSTEM

BACKGROUND OF INVENTION

1. Field of the Invention

The present invention relates to a contour stitching machine for making a predetermined stitch pattern in juxtaposed garment pieces and more particularly, including a stitch pattern cartridge for use therewith whereby juxtaposed garment pieces will be displaced in a manner determined by a pattern path contained in the stitch pattern cartridge.

2. Description of Prior Art

There are basically two types of contour stitching machines known and namely, mechanical or electronic controlled machines. With the mechanical systems known, it is necessary to provide a separate motor to drive a carriage which guides the fabric under a sewing head. An additional motor is required to drive the needle in the sewing head and therefor synchronization of these two motors is necessary. Further, in order to obtain a back tack at each end of a predetermined stitch pattern, the motor that drives the carriage system has to be reversed on the beginning and on the end of the stitch pattern path. This requirement for back tacking causes further problems of synchronization of the motors and results in complex design structures.

Electronically controlled carriage systems known are fairly expensive as they operate with numerically controlled computers to move a carriage along an X-Y axis guided by the stored program in the computer. These types of systems are also quite complex and the present invention is not concerned with such, but to a mechanical solution which is more economical, and which provides the same advantages as an electronically controlled pattern stitching system.

SUMMARY OF INVENTION

It is therefore a feature of the present invention to provide a contour stitching machine which substantially overcomes all the above-mentioned disadvantages and in which a stitch pattern can be changed by merely replacing a cartridge.

A further feature of the present invention is to provide a stitch pattern cartridge for use in a contour stitching machine which is simple in construction, economical and reliable and easily installed in the machine.

In accordance with the above-mentioned features, from a broad aspect, the present invention provides a stitch pattern cartridge for use with a contour stitching machine for making a predetermined stitch pattern in juxtaposed garment pieces. The machine has a sewing head with a threaded needle. A clamping member releasably secures the juxtaposed garment pieces in a predetermined plane and displaces them under the needle of the sewing head. A follower means is associated with the clamping member for displacing same. The cartridge comprises a housing having a top wall with a guide slot therein which defines a predetermined stitch pattern path. Engagement drive means is provided for displacing the follower means when placed in the guide slot and in a predetermined manner whereby the garment piece will be displaced under the needle in a manner determined by the pattern path of the guide slot.

BRIEF DESCRIPTION OF DRAWINGS

The present invention will now be described with reference to a preferred embodiment illustrated by the accompanying drawings in which:

FIG. 1 is a plan view of a contour stitching machine constructed in accordance with the present invention;

FIG. 3 is an enlarged sectional view of the area A shown in FIG. 1;

DESCRIPTION OF PREFERRED EMBODIMENTS

Figure 2:
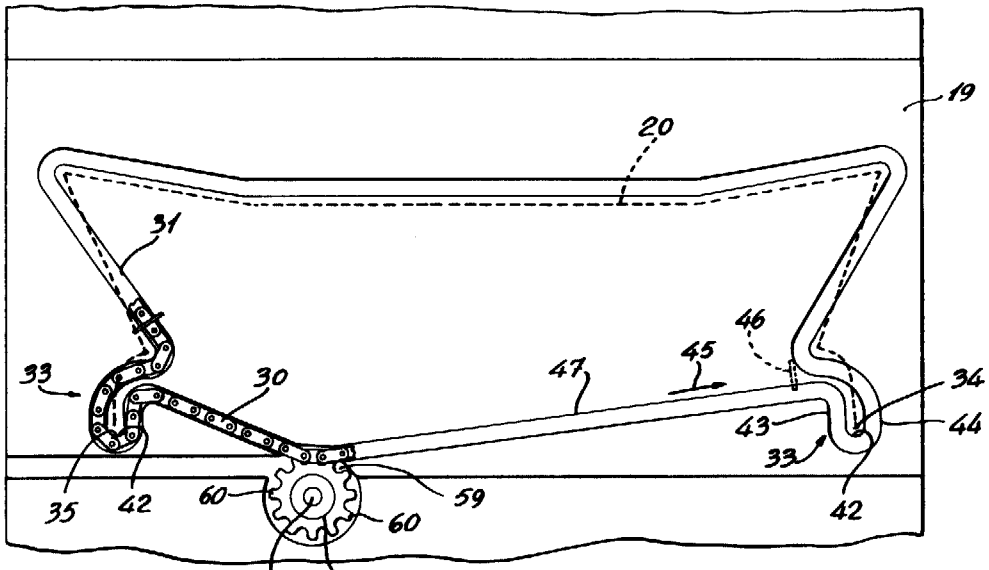
FIG. 2 is a fragmented plan view of the stitch pattern cartridge constructed in accordance with the present invention.

Referring to the drawings, there is shown generally at 10 a contour stitching machine constructed in accordance with the present invention. The machine comprises a sewing head 11 having a threaded needle (not shown) which is positioned above a fabric support surface 12. A clamping member 13, such as two clamping bar arrangement, releasably secures juxtaposed garment pieces 14 therebetween. The clamping member 13 displaces the juxtaposed garment pieces 14 in a predetermined plane under the needle (not shown). Follower means 15 is secured to an end of the clamping member 13 for imparting a predetermined horizontal and vertical movement to the clamping member within a predetermined plane.

A cavity 16, or other suitable cartridge positioning means, is provided in a support surface 17 and disposed relative to the needle whereby to accommodate therein a stitch pattern cartridge 18. The stitch pattern cartridge 18 has a top wall 19 provided with pattern guide means hereinshown as a guide slot 20. The follower means 15 (see FIG. 3) is provided with a pin 21 at an extremity of an extension piece 22. The pin 21 is positioned within the guide slot 20 at a predetermined location and is displaced therealong by engagement drive means. The pin is moved along the guide slot in a predetermined manner whereby the garment pieces 14 will be displaced under the needle (not shown) in a manner which is determined by the pattern path defined by the guide slot 20. Thus, the garment pieces 14 will be moved under the needle whereby a contour stitch 67 is formed along a predetermined peripheral edge thereof and corresponding to the pattern defined by the slot 20 in the cartridge 18.

As shown in FIGS. 2 and 3, the engagement drive means is an endless chain 30 which is entrained in an endless guide channel 31 whereby the chain can be guided under the guide slot 20 which defines the stitch path. The guide channel 31 further guides the endless chain 30 along a back tacking path shown generally at 33, at both the first end 34 and the second end 35 of the stitch pattern path or slot 20.

Figure 4:
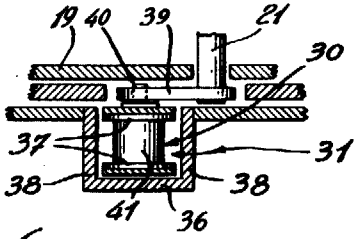
FIG. 4 is a fragmented sectional view showing the disposition of the endless driven member in the guide channel.
Figure 5:
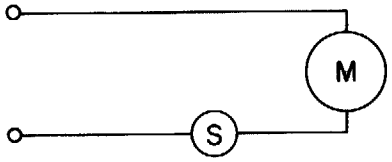
FIG. 5 is a drive motor circuit schematic.

As shown in cross-section in FIG. 4, the endless guide channel 31 is constructed of a hard wearing material, for example, sheet metal material or hard plastics and defines a bottom wall 36 on which a side link 37 of the endless chain 30 rests in facial contact. The side walls 38 guide the endless chain 30 around the various bends provided in the endless path defined thereby. As can be seen, the top end of the channel is opened and at least one pusher arm 39 is secured to a protruding end 40 of a respective link pin 41 which extends between the side links 37 of the chain. Thus, the pusher arms 39 will be displaced above the open top end of the guide channel 31 and one of these will be in pushing engagement with the pin 21 to displace it along the stitch pattern path or slot 20 in a predetermined manner as will be described later.

The back tacking paths 33 are both defined by forming a U-shaped bend in the guide channel 31 with the bottom portion 42 of each U-shaped bend defining respectively the first and second end 34 and 35, of the stitch pattern path 20. Each U-shaped bend defines opposed side channel sections 43 and 44 whereby when the pusher arm is guided in the direction of the arrow 45 and from a start position 46 with the pin 21 positioned at a start position 56 (see FIG. 3) in advance of the first end 34, the arm 39 will firstly push the follower pin 21 towards the first end 34. When the pin 21 reaches the end of the guide slot 20 at the first end 34 the pusher arm will be caused to turn around the pin 21 by the trajectory it follows by the U-shape guided movement at the bottom 42 of the U-shaped bend.

However, as the pusher arm is entrained along the channel section 44 it will again engage the follower pin 21 and push it along the guide slot 20. Thus, there is formed a double stitch (back tack) along a section at the first end of the juxtaposed fabric which is guided in accordance with the movement of the follower pin 21. The follower pin 21 is then pushed along the guide slot to the second U-shaped bend 35 at the second end of the guide slot. As the pusher moves around the bottom of the U-shaped bend it will again disengage and engage the follower pin 21 and move it up to an end position in advance of the second end 35 of the guide slot 20, whereby a double row of stitches (back tack) is also formed at the second end of the stitch pattern path 20.

In order not to displace the chain unnecessarily and to minimize operation procedures, there are normally at least two pusher arms 39 secured to the endless chain 30. These pusher arms are secured a predetermined distance from one another whereby as one of the pusher arms releases the follower pin in advance of the second end of the pattern path 32 the other pusher arm is located at start 46 in close proximity to the start position of the follower pin in advance of the first end 42. However, this arrangement is possible only with stitch pattern paths of certain lengths. In order to stop the pusher arms at start position 46 a stop means, hereinshown as a sensor switch S, is positioned in the area of the second U-shaped bend end 35 of the channel 31. The clamping member 13 will cause activation of the sensor switch when the follower pin 21 is at the end 35 of the bend 33 whereby to cause a drive motor M to stop, after a predetermined time delay, whereby to make the back tack stitches. While the motor is stopped, the operator has sufficient time to change the garment pieces 14 on the clamping member 13 and to reposition the follower pin 21 at the start position 56 (as shown in FIG. 3) adjacent the first end of the pattern path 20. When the length of the chain along the channel 31 from the start position 46 to the stop position through the path 20 is longer or shorter than the length of the chain between position 46 and the stop position, it is necessary to secure additional pusher arms to the chain, at precalculated distances whereby an engageable pusher arm 39 will always be at start position 46 when the sensor switch is activated at the end of a switch pattern cycle.

As shown in FIG. 2, the endless chain 30 is driven by a drive sprocket 57 connected to a drive shaft 58 of the drive motor M. This motor also drives the sewing head needle. An opening 59 is provided in one of the side walls 38 of the channel 31 whereby a drive sprocket tooth 60 will engage between the link pins 41 of the endless chain to make positive drive engagement therewith. Thus, as soon as the sprocket is stopped, the chain will also be stopped as it is in engagement with the sprocket teeth.

Referring again to FIG. 1, there is shown restraining guide means 65 for maintaining the clamping member 13 in a predetermined plane, hereinshown in a horizontal plane, whilst permitting displacement of the clamping member both horizontally or vertically whilst maintaining the fabric secured thereto. As also shown in FIG. 1 the garment is preferably precut to its desired shape which matches the shape of the slot in the cartridge 19. Of course, the garment pieces will be slightly larger than the slot configuration whereby the predetermined stitch pattern 67 will be made inwardly of the marginal edge 68 of the fabric.

The operation of the contour stitching machine 10 herein described is relatively simple. The operator of the machine selects the correct fabric pieces to be contour switched and clamps same at a predetermined location on the clamping member 13. The follower pin 21 is then placed to its start position and the material is automatically displaced whereby the needle will lie above a start position thereover where the stitch is to be started. By switching on the drive motor M the pusher arm 39 will move the follower pin 21 to effect a back tack at the first end of the guide slot 20 and then move it along the guide slot to the second end where a further back tack is formed. After the formation of the second back tack a switch is energized automatically and shuts off the motor. The operator then removes the stitch juxtaposed fabric and inserts two further juxtaposed fabric pieces and repeats the operation.

I claim:

1. A contour stitching machine for making a predetermined stitch pattern in juxtaposed garment pieces, said machine comprising a sewing head having a threaded needle positioned above a fabric support surface, pattern guide means having a guide slot disposed relative to said needle and defining a predetermined stitch pattern path, a clamping member for releasably securing said juxtaposed garment pieces in a predetermined plane and for displacement of said secured garment pieces under said needle, follower means associated with said clamping member for displacing same, said follower means engaging said guide slot, engagement drive means for displacing said follower means along said guide slot in a predetermined manner whereby said garment pieces will be displaced under said needle in a manner determined by the pattern path of said guide slot, said engagement drive means including an endless driven member, positioned below said guide slot, and guide means for guiding said endless driven member along said stitch pattern path from a first end to a second end, said guide means further guiding said endless driven member along a non-reversing back tacking path at both said first and second ends and between said back tacking paths, the back tacking at each of the first and second ends being along an initial stitching line.

2. A contour stitching machine as claimed in claim 1 wherein said endless driven member is an endless chain link, said endless chain being disposed in an endless guide channel shaped to guide said endless chain adjacent said stitch pattern path, said back tacking paths and between said back tacking paths.

3. A contour stitching machine as claimed in claim 2 wherein said guide channel has a bottom wall and opposed side walls and defining an open top end, a pusher arm secured to said endless chain and displaceable thereby above said open top end, said pusher arm being in pushing engagement with said follower means along said stitch pattern path and said back tacking paths.

4. A contour stitching machine as claimed in claim 3 wherein each said back tacking paths is defined by forming a U-shaped path in said channel path, the bottom of said U-shaped path defining respectively said first and second end of said stitch pattern path.

5. A contour stitching machine as claimed in claim 4 wherein each said U-shaped paths defines opposed side channel sections and a bottom channel section, said pusher arm when guided along said U-shaped path at said first end of said pattern path causing movement of said follower means from a start position in advance of said first end of said stitch pattern path to said first end and further causing movement of said follower means from said first end along said pattern path to said second end constituted by said bottom channel section of said other U-shaped path and then to an end position in advance of said second end whereby said needle will form a double row of stitches along a predetermined distance adjacent said first and second end of said predetermined stitch pattern.

6. A contour stitching machine as claimed in claim 5 wherein there are two pusher arms secured to said endless chain, said pusher arms being secured at predetermined locations on said endless chain whereby as one of said pusher arms releases said follower means in advance of said second end said other pusher arm is located at a start position in close proximity to said start position in advance of said first end, and stop means to stop said endless chain when said follower means is at said advance position of said second end.

7. A contour stitching machine as claimed in claim 6 wherein there is a drive motor having coupled thereto a drive motor circuit, said stop means is a sensor switch connected to said drive motor circuit, said drive motor being connected to a drive sprocket, said guide channel having an opening in a side wall thereof, said drive sprocket being secured adjacent said opening whereby teeth of said sprocket will engage between chain links of said endless chain to displace it in said guide channel.

8. A contour stitching machine as claimed in claim 1 wherein said follower means is a pin secured to an end of said clamping member, and restraining means for maintaining said clamping member in a predetermined plane whilst permitting horizontal or vertical displacement thereof.

9. A contour stitching device as claimed in claim 8 wherein said juxtaposed garment pieces are displaced under said needle along a predetermined stitch pattern identical to said stitch pattern path of said guide slot.

10. A contour stitching device as claimed in claim 5 wherein said pattern guide means is a guide slot in a top wall of a housing, and there are means mounting said last mentioned housing for replacement whereby to provide guide means having slots of different predetermined stitch pattern paths.

11. A stitch pattern cartridge for use in a contour stitching machine for making a predetermined stitch pattern in juxtaposed garment pieces and having a sewing head with a threaded needle, a clamping member for releasably securing said juxtaposed garment pieces in a predetermined plane and for displacement of said secured garment pieces under said needle, a follower means associated with said clamping member for displacing same, said cartridge comprising a housing having a top wall, a guide slot in said top wall and defining a predetermined stitch pattern path, engagement drive means for displacing said follower means when placed in said guide slot and in a predetermined manner whereby said garment pieces will be displaced under said needle in a manner determined by the pattern path of said guide slot, said engagement drive means being an endless driven member positioned in an endless guide channel below said guide slot, at least one pusher arm secured to said endless driven member for pushing engagement with said follower means along said stitch pattern path, said endless guide channel guiding said endless driven member along a non-reversing back tacking paths at a first end and a second end of the predetermined stitch pattern path, the back tacking path at each of the first and second ends being along an initial stitching line.

12. A stitch pattern cartridge as claimed in claim 11 wherein there are means for releasably securing said cartridge housing in a cavity in said contour stitching machine positioned relative to said needle.

13. A stitch pattern cartridge as claimed in claim 12 wherein said endless driven member is engaged and driven by drive means in said stitching machine and releasably engageable with said endless driven member when said cartridge is positioned in said cavity.

14. A contour stitching machine as claimed in claim 1 wherein a drive motor is provided to impart a drive to needle in said sewing head and also to said engagement drive means.

* * * * *